US005640816A

United States Patent [19]

Reiland et al.

[11] Patent Number: 5,640,816

[45] Date of Patent: Jun. 24, 1997

[54] FREESTANDING MODULAR CHANGING ROOM SYSTEM

[75] Inventors: Mary J. Reiland; Kenneth H. Reiland, both of Apple Valley; David J. Lehse; John M. Darst, both of Oakdale, all of Minn.

[73] Assignee: Four D Incorporated, Apple Valley, Minn.

[21] Appl. No.: 411,893

[22] Filed: Mar. 28, 1995

[51] Int. Cl.[6] ..... F04H 1/00

[52] U.S. Cl. ..... 52/239; 52/36.1; 52/284; 52/586.2; 160/135

[58] Field of Search ..... 52/239, 284, 64, 52/65, 70, 71, 86, 60.1, 36.1, 584.1, 586.2; 160/135, 351

[56] References Cited

U.S. PATENT DOCUMENTS

| | | | |
|---|---|---|---|
| Re. 27,215 | 11/1971 | Propst et al. | 52/36 |
| 2,744,714 | 5/1956 | Parke | 248/245 |
| 2,820,256 | 1/1958 | Dahl | 52/36.1 X |
| 3,466,777 | 9/1969 | Wistrand et al. | 40/125 |
| 3,555,746 | 1/1971 | Gelezuinas | 52/27 |
| 3,596,701 | 8/1971 | Cowan | 160/135 |
| 3,733,759 | 5/1973 | Schulte et al. | 52/122 |
| 3,834,092 | 9/1974 | Whisson | 52/36 |
| 3,861,101 | 1/1975 | Whisson | 12/238.1 |
| 3,866,364 | 2/1975 | Pollard | 52/36 |
| 3,866,381 | 2/1975 | Eschbach et al. | 52/586.2 X |
| 3,996,706 | 12/1976 | Bomgaars | 52/71 |
| 4,031,675 | 6/1977 | Roberts et al. | 52/36 |
| 4,038,790 | 8/1977 | Paisley | 52/36 |
| 4,186,533 | 2/1980 | Jensen | 52/184 |
| 4,388,783 | 6/1983 | Logie | 52/36 |
| 4,434,900 | 3/1984 | Cook | 160/135 X |
| 4,497,356 | 2/1985 | Luck et al. | 160/135 |
| 4,557,091 | 12/1985 | Auer | 52/282 |
| 4,560,130 | 12/1985 | Schwartz | 248/297.2 |
| 4,593,508 | 6/1986 | Curatolo | 52/239 |
| 4,601,138 | 7/1986 | Hampton | 52/86 |
| 4,724,644 | 2/1988 | Goodwin | 52/34 |
| 4,813,196 | 3/1989 | Bokelund et al. | 52/775 |
| 4,881,353 | 11/1989 | Braendel et al. | 52/239 |
| 4,918,879 | 4/1990 | Bodurow et al. | 52/36 |
| 4,944,416 | 7/1990 | Peterson et al. | 211/87 |
| 5,003,741 | 4/1991 | Yeh | 52/280 |
| 5,022,781 | 6/1991 | Smith | 404/6 |
| 5,056,285 | 10/1991 | Frascaroli et al. | 52/243 |
| 5,067,294 | 11/1991 | McGowan | 52/241 |
| 5,123,773 | 6/1992 | Yodock | 404/6 |
| 5,247,773 | 9/1993 | Weir | 52/586.2 X |
| 5,291,700 | 3/1994 | Chew | 52/36.1 |
| 5,487,690 | 1/1996 | Stoffle et al. | 52/584.1 X |

*Primary Examiner*—Carl D. Friedman
*Assistant Examiner*—Winnie Yip
*Attorney, Agent, or Firm*—Mueting, Raasch, Gebhardt & Schwappach, P.A.

[57] ABSTRACT

A lightweight, freestanding modular changing room system which can be assembled using few or no tools. The modular freestanding changing room system may consist of as few as four unique components—interchangeable wall panels, door panel assemblies, and two types of panel support columns. Additional components may be added to create more elaborate changing room configurations.

15 Claims, 12 Drawing Sheets

22
23
52
42
42
52
52
50
46
42
56
44
54
42
54
46
26

FREESTANDING MODULAR CHANGING ROOM SYSTEM

FIELD OF THE INVENTION

The present invention is directed to a modular changing room, and in particular, to a method and apparatus for providing a low cost, lightweight changing room that can be assembled and disassembled by a single individual, using few or no tools.

DESCRIPTION OF THE RELATED ART

Freestanding changing or fitting rooms, commonly found in retail clothing stores, suffer from a variety of shortcomings. Some freestanding changing rooms are constructed of wall panels attached to extruded members by various hardware, such as fasteners and pins. However, hardware adds to the complexity and cost of the system, as well as increasing the assembly time. Tools are often required for attaching hardware to wall panels or corner members of some freestanding changing rooms. Additionally, hardware has a tendency to come loose over time, which can undermine the stability of the structure.

Wall panels of some freestanding changing rooms are constructed of plywood or particle board, which is extremely heavy. The weight of the wall panels adds to the shipping cost, and hence the overall cost of the system. Due to the complexity of assembly and weight of some components, it is common practice to require two or more workers several days to assemble a typical freestanding changing room.

The corner members in many freestanding changing rooms support the weight of the wall panels. Consequently, the corner members can permanently deform carpeting and crack floor tiles. Consequently, many freestanding changing rooms which are theoretically mobile, are not moved in practice so as to hide damage to the underlying floor covering.

Another shortcoming of many prior changing rooms is that the wall panels are not symmetrical. Consequently, certain wall panels can only be used in certain locations, depending on the configuration of the freestanding changing room. These non-symmetrical panels add to the complexity of assembling the room and the overall cost of the system.

In many freestanding changing rooms, the doors for individual changing rooms are hung on the extruded corner members. Consequently, it is extremely important that the door frame is square and remains square over an extended period of time, so that the door closes properly.

SUMMARY OF THE INVENTION

The present invention is directed to a lightweight, modular, freestanding changing room system which can be assembled with few or no tools. The modular freestanding changing room system may consist of as few as four unique components—interchangeable wall panels, door panel assemblies, and two types of panel support columns.

The modular freestanding changing room system of the present invention consists essentially of symmetrical wall panels, panel support columns, and door panels which can be assembled easily and quickly with the use of few or no tools.

The extruded panel support columns have at least two pairs of opposing side walls, each defining a channel. Each side wall has a flange protruding into the channel for engagement with a mating slot along an edge portion of wall panels and door panel assemblies. The door panel assemblies and wall panels have a common width so that they are interchangeable at any location along the modular changing room. The door panel assemblies are preferably symmetrical, so that they can be reversed to provide a door opening inward or outward relative to a changing room.

The flanges on the panel support columns and elongated slots along the edge portions of the wall panels have a complementary curved surface. However, it will be understood that a variety of shapes may be used for engaging the wall panels with the panel support columns.

The height of the wall panels may be less than the desired height of the walls of the modular changing room to reduce transportation costs. The top and bottom edges of the wall panels may be configured to interlock, such as with a tongue and groove arrangement. For example, the top edge of the panels may have a tongue portion and the bottom edge may have a groove portion so that the panels can be stacked in a releasable interlocking configuration. In one embodiment, the panel support columns are one third the desired height of the walls of the modular changing room so that a single panel support column spans the joint between an upper and a lower wall panel.

The panel support columns may also include a recess for receiving a merchandise display support member along an external surface of the modular changing room system. The merchandise display support member permits standardized merchandise display racks to be attached to an external surface of the changing room system.

Archway connectors may be used for connecting one or more changing rooms so as to provide additional stability to the modular changing room system. Archway connectors are particularly important when merchandise display racks are attached to an external surface of the changing room.

The present invention is also directed to a kit for constructing a modular changing room system.

The present method for assembling a modular changing room comprises slidably engaging extruded panel support columns with the side edge portions of wall panels and door panel assemblies until the modular changing room assumes the desired configuration. The modular nature of the changing room system permits additional changing rooms to be added to an existing freestanding changing room as needed.

The method of assembling the module changing room may also include slidably engaging a merchandise display support member into a recess in the panel support column along an external surface of the changing room system. A merchandise display may be attached to the display support member for providing additional merchandise display space.

DETAILED DESCRIPTION OF THE PREFERRED EMBODIMENT

Figure 1:
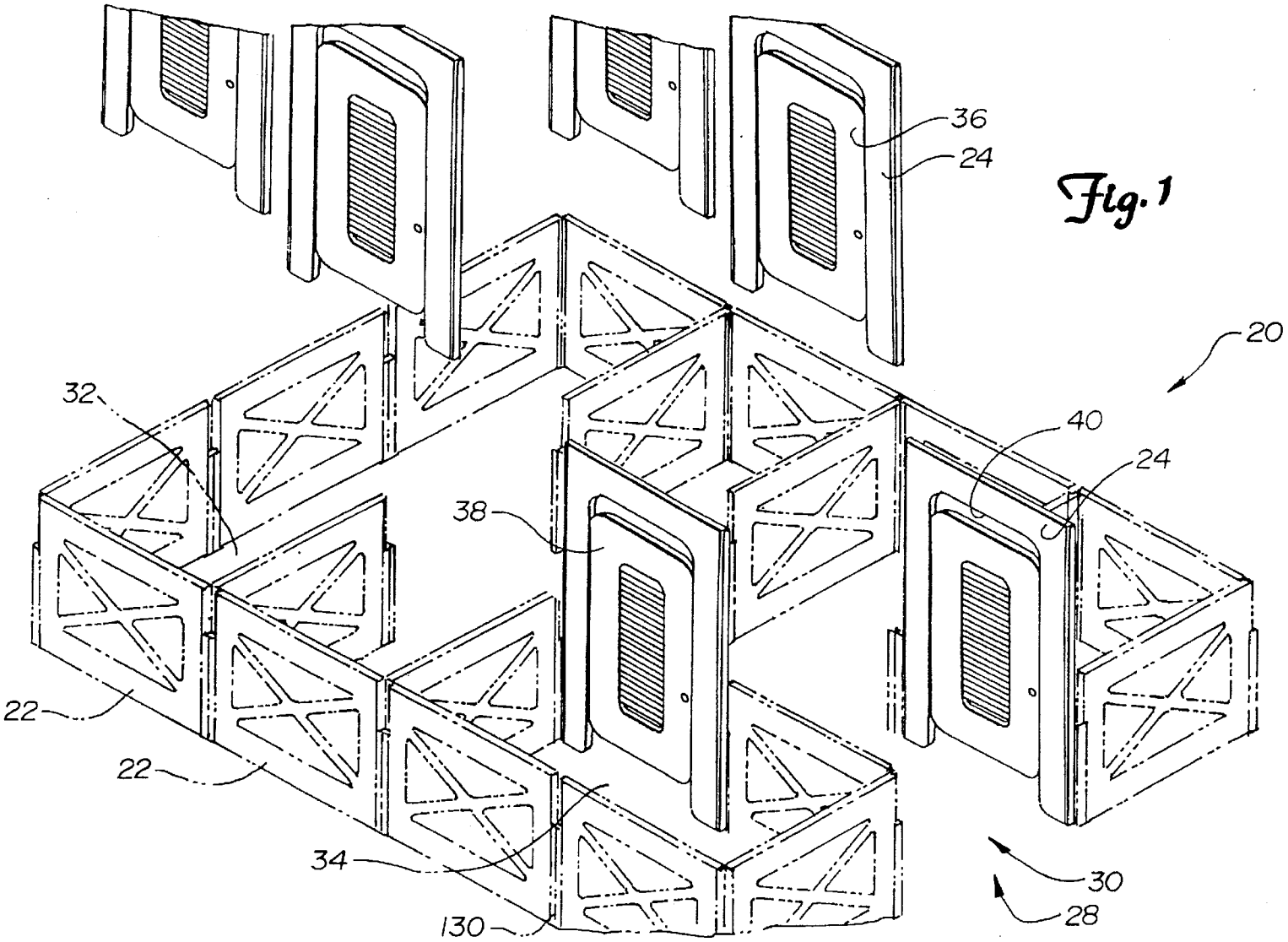
FIG. 1 is a schematic illustration of an exemplary modular changing room system.
Figure 2:
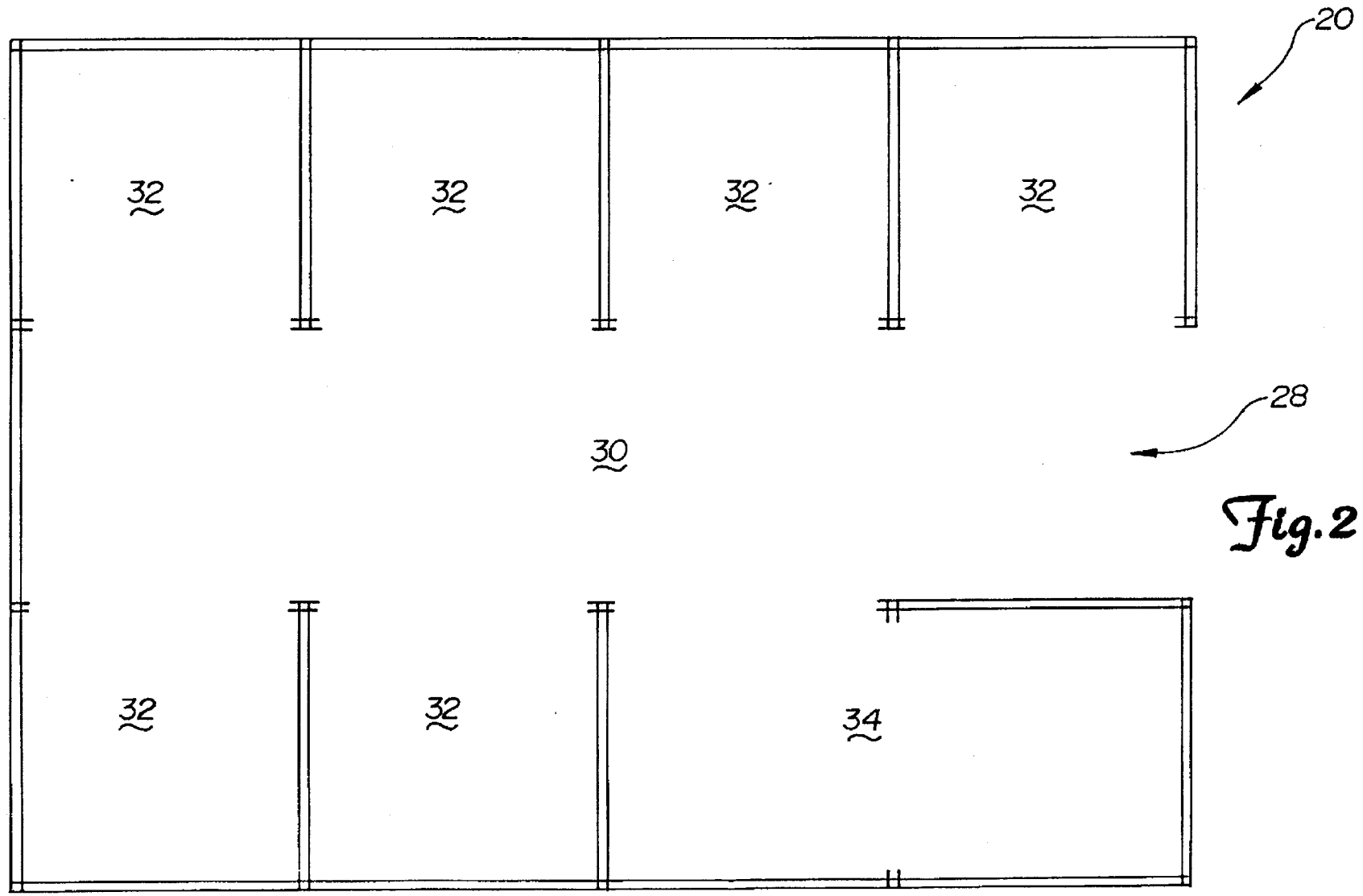
FIG. 2 is an exemplary layout of the present modular changing room.

FIGS. 1 and 2 illustrate an exemplary configuration of a freestanding modular changing room system 20. It will be understood that the present modular changing room system can be arranged in a virtually unlimited number of configurations. A plurality of wall panels 22 and door panel assemblies 24 are connected along edge portions thereof by lower panel support columns 26. The lower panel support columns 26 extend approximately ⅓ the height of the door panel assemblies 24 and the lower wall panels 22 are approximately ½ the height of the door panel assemblies 24.

The exemplary freestanding modular changing room system 20 of FIGS. 1 and 2 is configured with an entrance 28 to a hallway 30 along which all of the door panel assemblies 24 are located. Doors 36 on the door panel assemblies 24 are preferably constructed to only open in one direction. The door panel assemblies 24 are symmetrical so that they can be reversed to permit the door 36 to open in either direction. For example, the door 38 on a handicapped access room 34 is arranged to open inward, while the remainder of the doors 36 for the other changing rooms 32 are arranged to open outward. As will be discussed in detail below, the door panel assemblies 24 are constructed of a rigid material which ensures that door frame 40 remains square relative to the doors 36, even if the modular changing room system 20 is assembled on an uneven surface or shifts during use.

Figure 3:
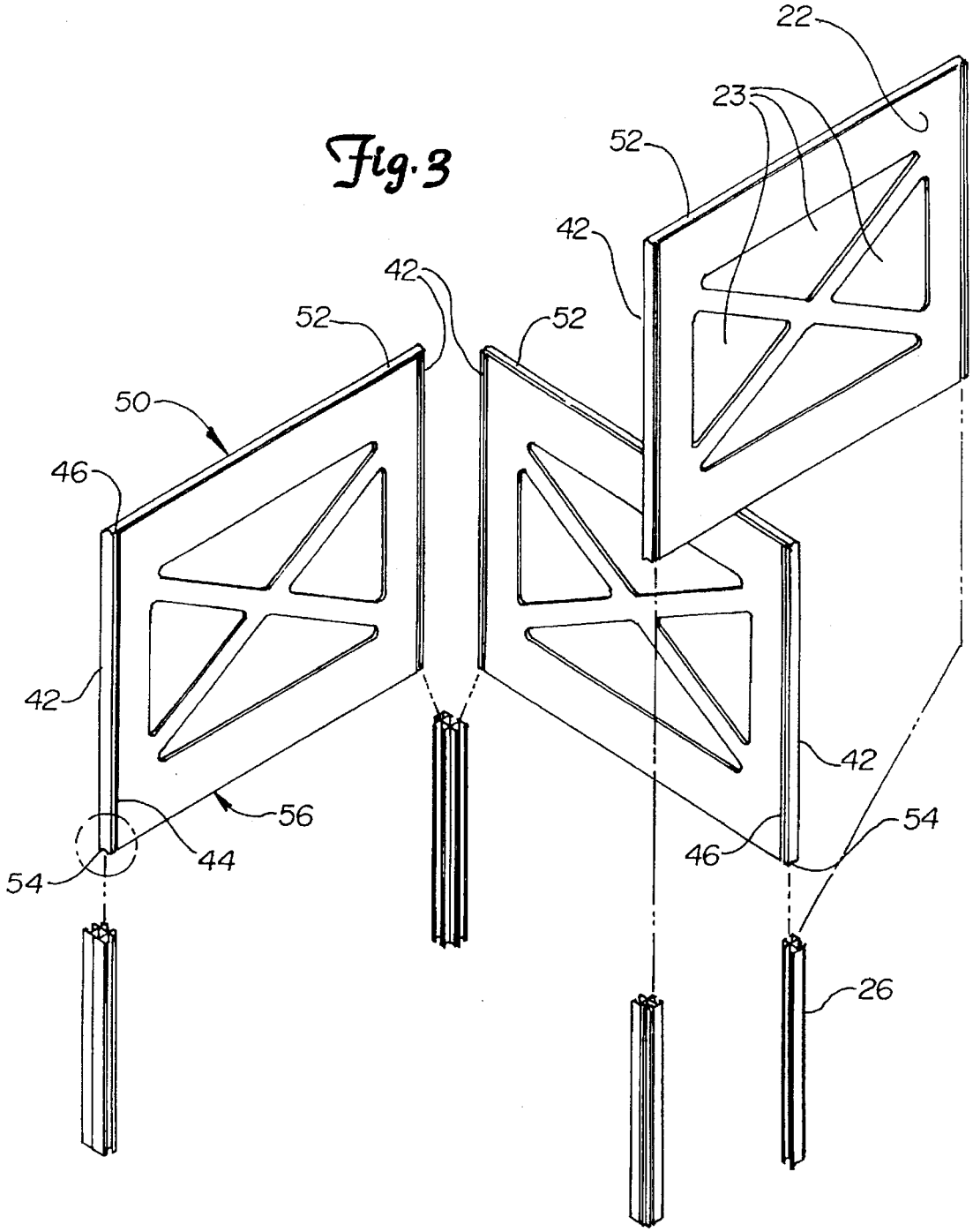
FIG. 3 perspective view of wall panels being engaged with panel support columns for assembling the present modular changing room.
Figure 4:
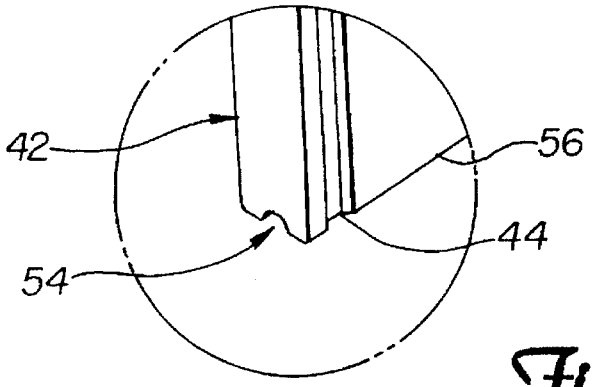
FIG. 4 illustrates a side edge portion of an exemplary wall panel.

FIGS. 3 and 4 illustrate the engagement of a group of lower wall panels 22 with lower panel support columns 26. The lower wall panels 22 may include various structural recesses 23 to increase the structural integrity of the panels 22. A pair of slots 44, 46 are formed along edge portions 42 of each of the wall panels 22 (see FIG. 5). As will be discussed below, slots 44, 46 engage with complementary flanges 48, 50 (see FIG. 5) on the lower panel support columns 26. Top edge 50 of the lower wall panels 22 has a tongue portion 52 which engages with a mating groove portion 54 on the bottom edge 56 of an upper wall panel 60, as is illustrated in FIGS. 6*a*–6*c*.

Figure 5:
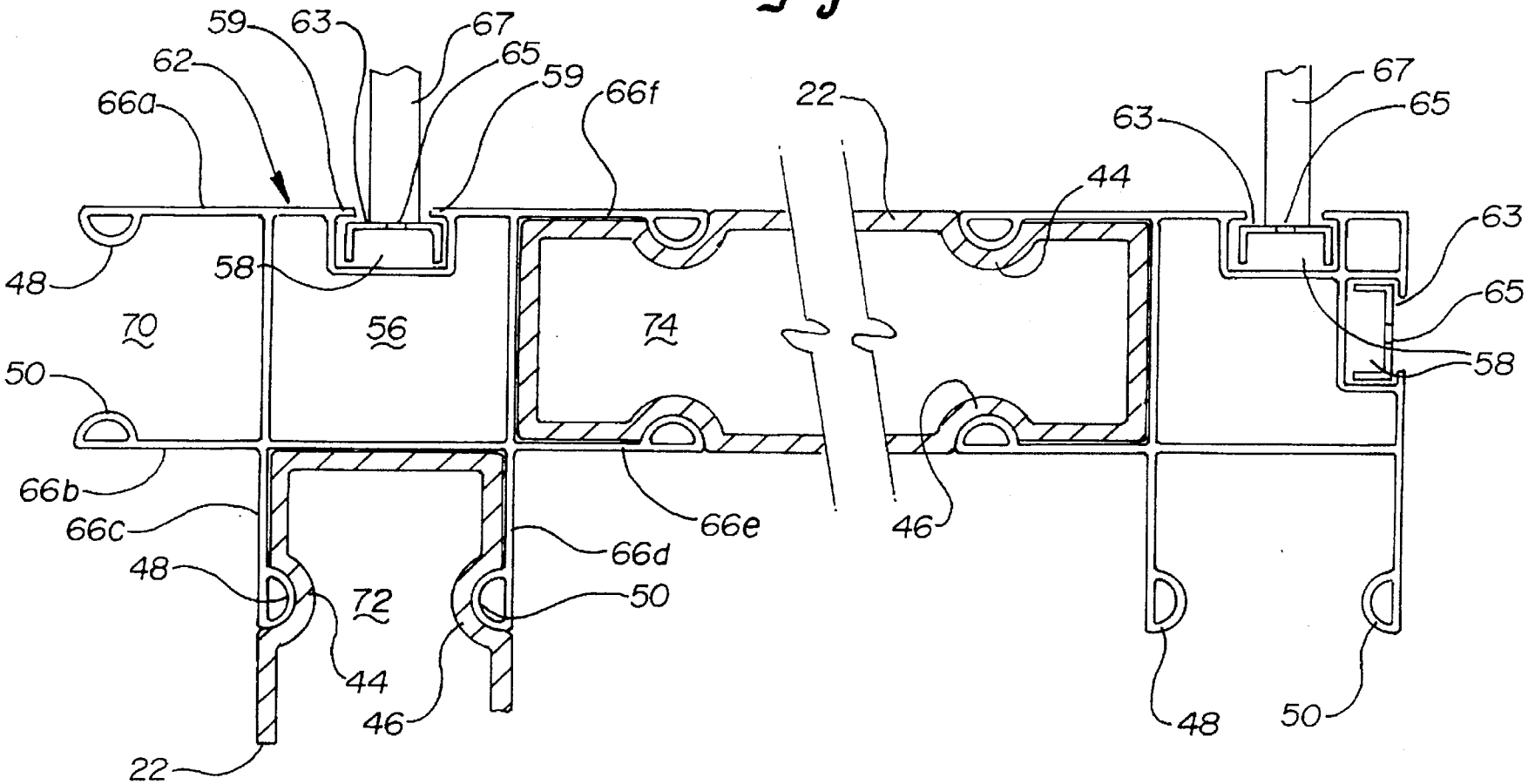
FIG. 5 is a sectional view of a wall panel engaging with exemplary panel support columns.

FIG. 5 is a sectional view of the lower wall panels 22 engaged with a 3×90 panel support column 62 and a 2×90 panel support column 64. The 3×90 panel support column 62 permits three lower wall panels 22 to be attached at 90° increments. The 2×90 panel support column 64 permits two lower wall panels 22 to be attached at right angles. Side walls 66*a* and 66*b* define a channel 70 along one edge of the 3×90 panel support column 62. Likewise, side walls 66*c*–66*f* define additional channels 72, 74 at right angles to the channel 70. First and second flanges 48, 50 protrude into the channels 70, 72, 74 from the side walls 66*a*–66*f*. The slots 44, 46 in the lower wall panels 22 engage with the flanges 48, 50 to form a secure structure.

Recesses 58 with tabs 59 are formed along outside edges 61 of the panel support columns 62, 64 for receiving a merchandise display support member 63. The merchandise display support member 63 may be any of a variety of standardized extrusions, which typically contain a plurality of slots 65 for receiving merchandise display racks or shelving 67.

Figure 6C:
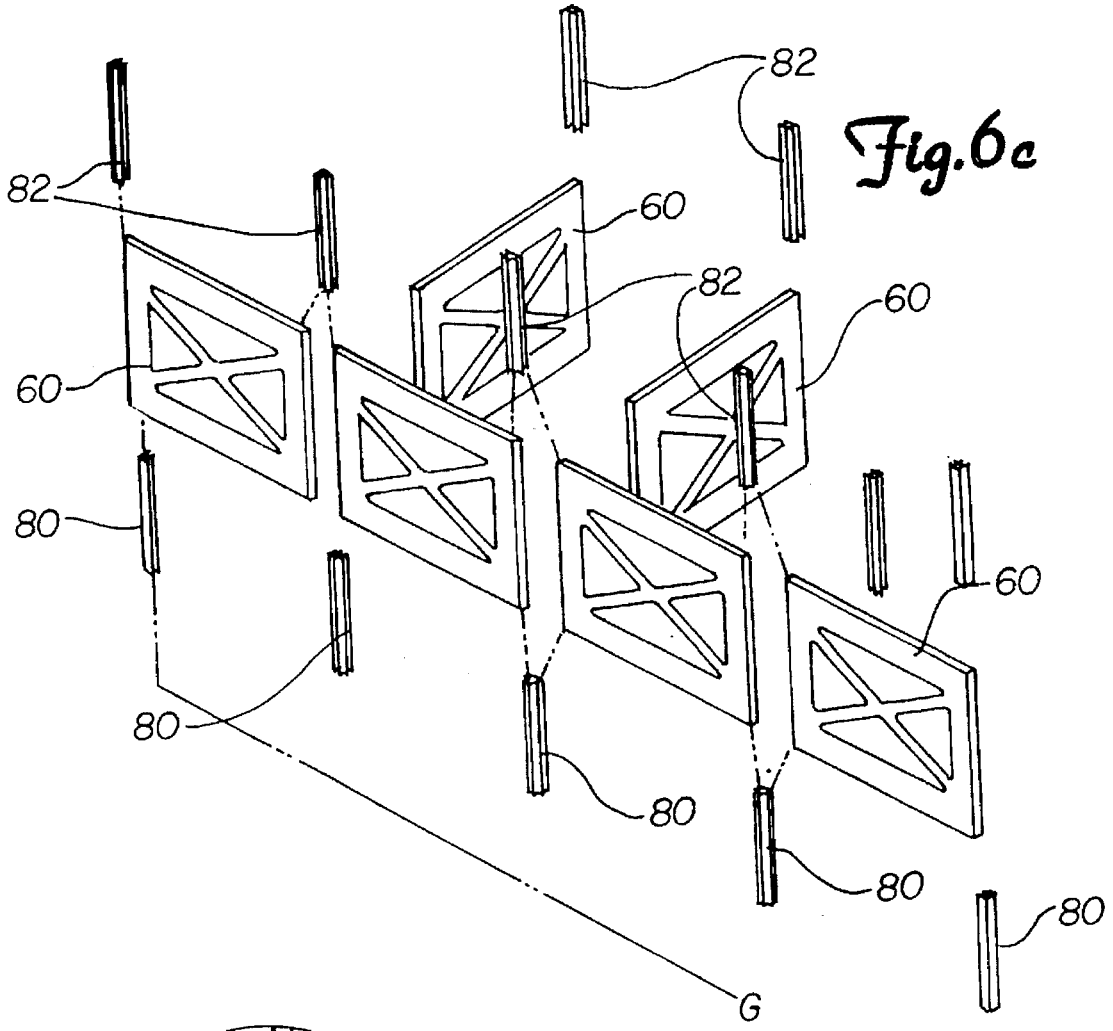
FIGS. 6*a*–6*c* illustrate the final assembly of the exemplary modular changing room of FIG. 1.
Figure 6A:
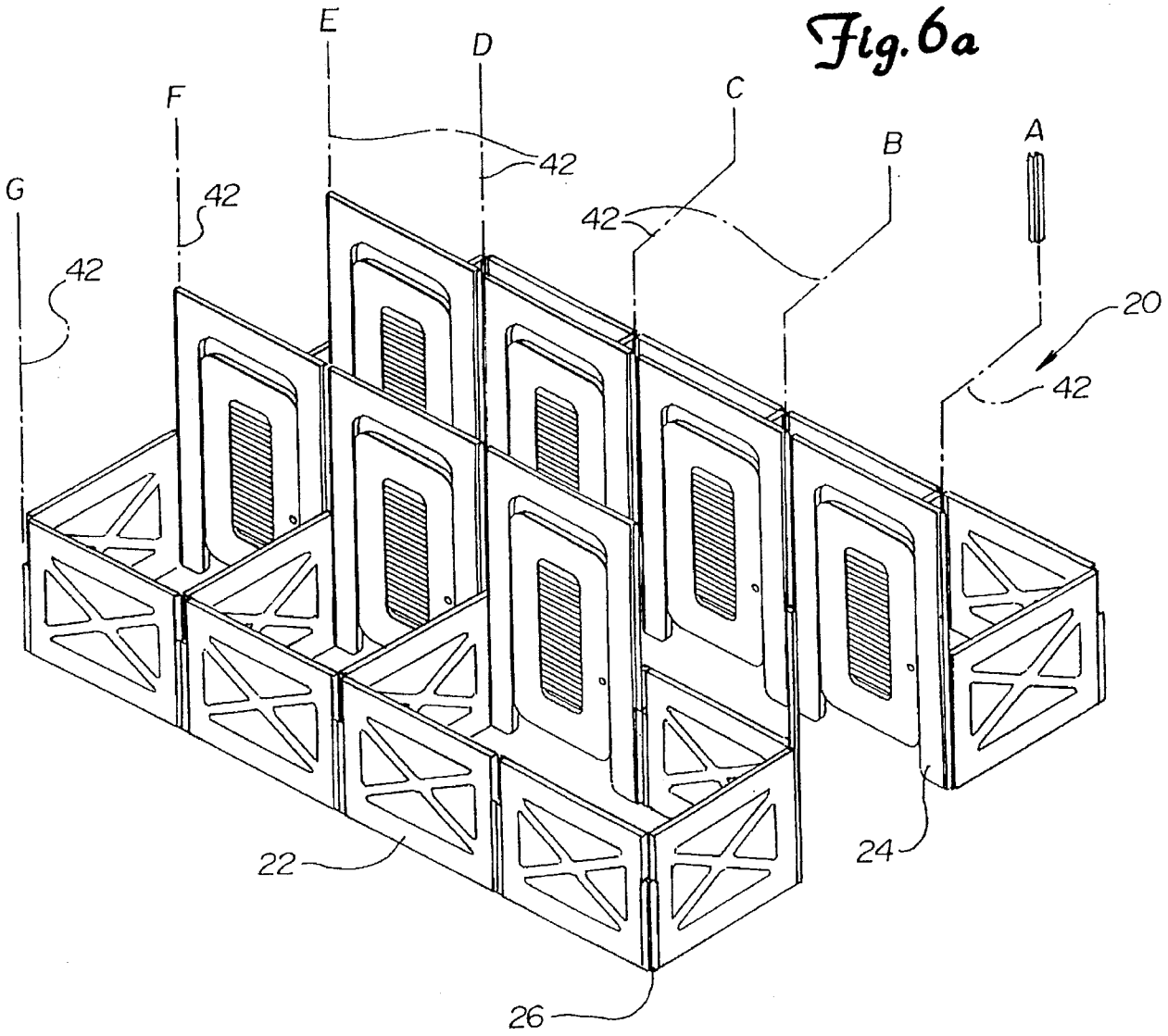
Figure 6B:
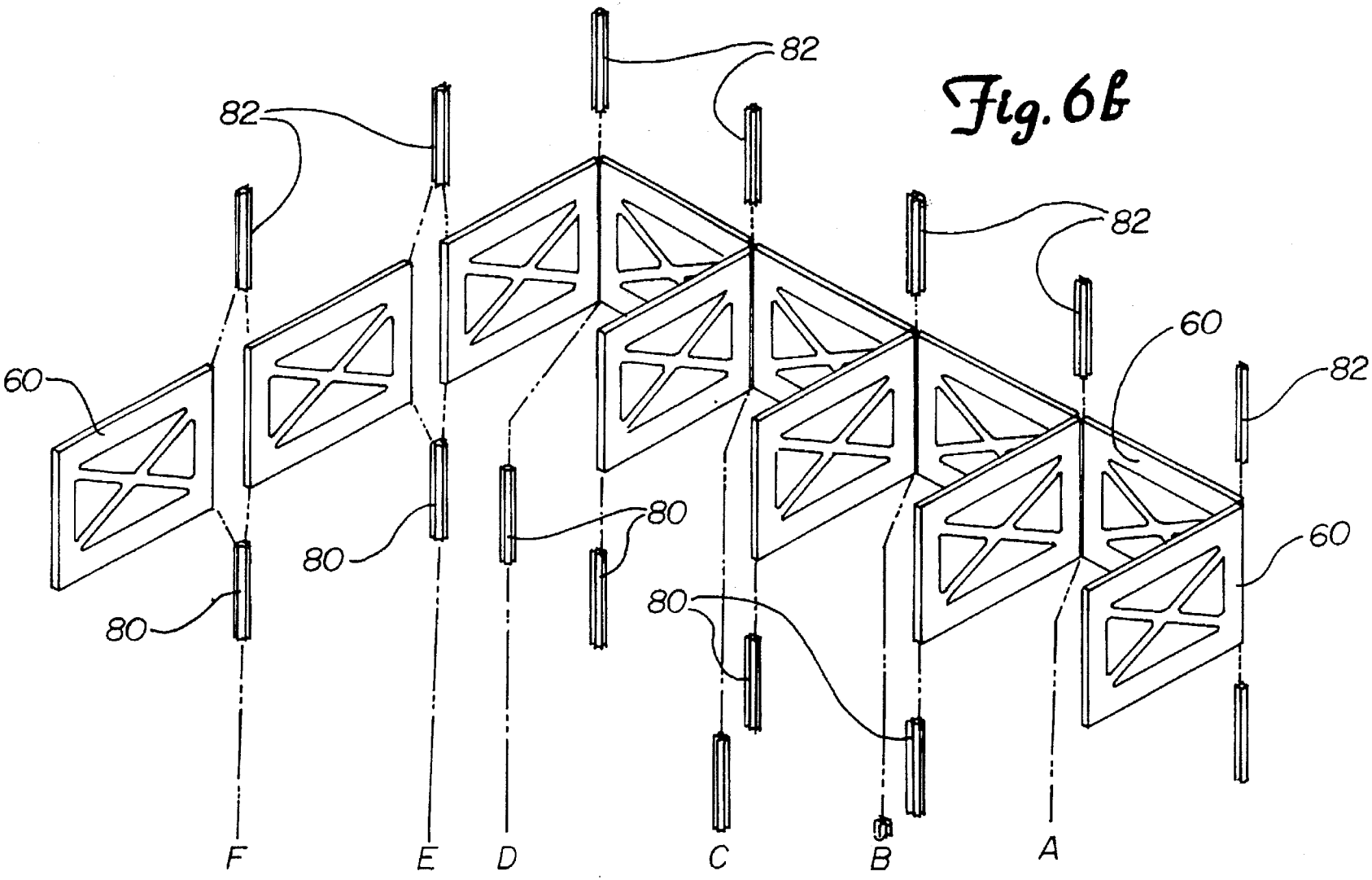

FIGS. 6*a*–6*c* illustrate the step of assembling the upper wall panels 60 to the exemplary modular changing room system configuration 20 of FIGS. 1 and 2. Middle panel support columns 80 illustrated in FIGS. 6*b* and 6*c* are inserted along the edge portions 42 (lines A–G) of the modular changing room system 20 illustrated in FIG. 6*a*. As discussed above, the lower panel support columns 26 only extend approximately ⅓ the height of the door panel assemblies 24. Consequently, approximately half the length of the middle panel support columns 80 extend along the lower wall panels 22. The upper wall panel 60 and the upper panel support columns 82 are likewise engaged with the middle panel support columns 80 along lines A–G of the modular changing room system 20 of FIG. 6*a*.

The lower, middle and upper panel support columns 26, 80, 82 along a particular edge portion 42 are preferably identical. Additionally, the upper and lower wall panels 22, 60 preferably are identical, so as to be completely interchangeable. In particular, the tongue portion 52 (see FIG. 3) of any panel 22, 60 may be interlocked with the groove portion 54 of any other wall panels 22, 60.

The panel support columns 26, 80, 82 are preferably constructed of extruded aluminum. However, it will be understood that they may be constructed of a variety of materials, including other metals, plastic, or composite materials. The wall panels 22, 60 and door panel assemblies 24 are preferably constructed of high density polyethylene plastic using a blow molding process which creates a hollow panel which is extremely lightweight and durable. The wall panels 22, 60 and door panel assemblies 24 may alternatively be constructed of low density polyethylene, polypropylene, other thermoplastic materials and thermoset plastics. A roto-molding may be substituted for the blow molding process. Depending on the construction of the various components, it has been found that a rubber mallet may be necessary to slide the wall panels 22, 24, 60 into the panel support columns 26, 80, 82 and to insure that the tongue and groove portions 52, 54 are interlocked.

Figure 7:
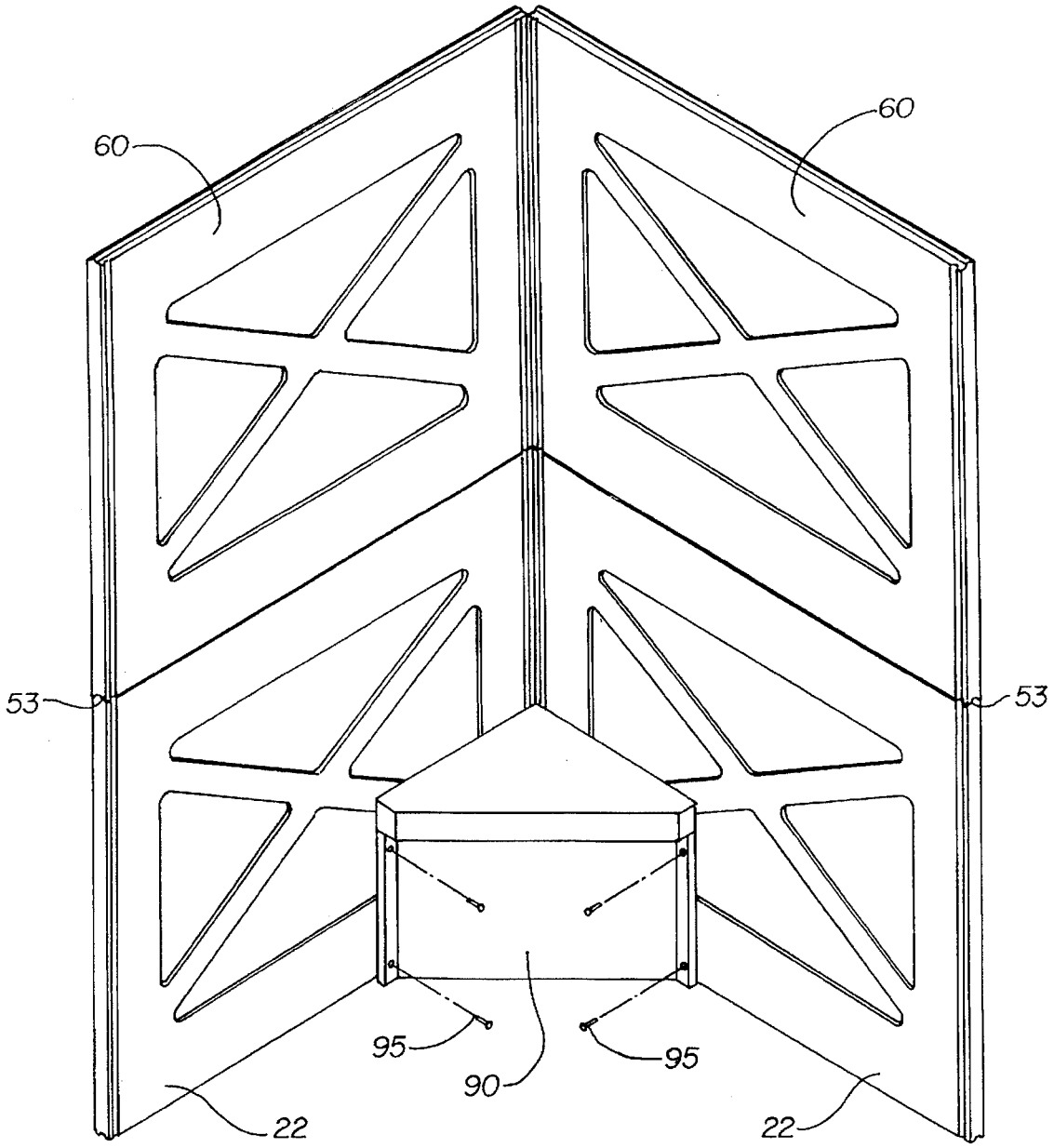
FIG. 7 illustrates an exemplary seat attached to wall panels of a modular changing room.

FIG. 7 is a perspective view of a seat 90 attached to a corner formed by two lower wall panels 22. The seat 90 may be attached to the wall panels 22 by a variety of fasteners 95, which are known in the art. If screws are used for fasteners 95, a screw drive will be required. FIG. 7 also illustrates the interlocking engagement 53 of the upper wall panel 60 with the lower wall panel 22.

Figure 8:
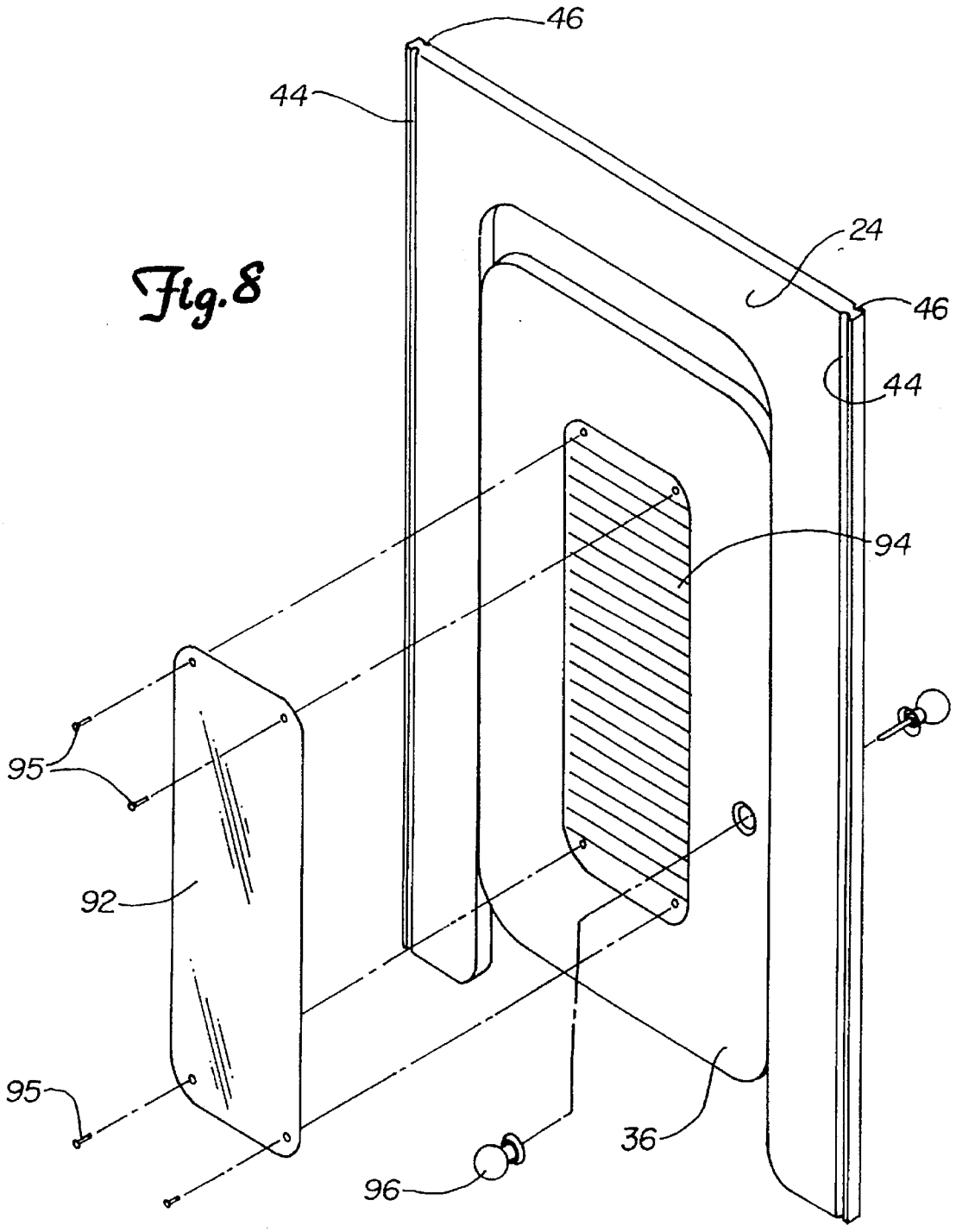
FIG. 8 is a perspective view of an exemplary door panel assembly for a modular changing room.

FIG. 8 is a perspective view of an exemplary door panel assembly 24. The door 36 is preferably hinged to the door panel assembly 24 so that it opens only in one direction. A mirror 92 may be attached to a recess 94 on the inside surface of the door 36 by fasteners 95. A similar recess is located on the opposite side of the door 36 (not shown) to permit the mirror 92 to be moved in the event that the door panel 24 is reversed to open in the other direction. As discussed in connection with FIG. 3, the edge portion 42 of the door panel assemblies 24 have the same slot configuration 44, 46 for engagement with the panel support columns 26, 80, 82. Finally, a doorknob or other suitable closure means 96 may be provided with the door 36.

Figure 9:
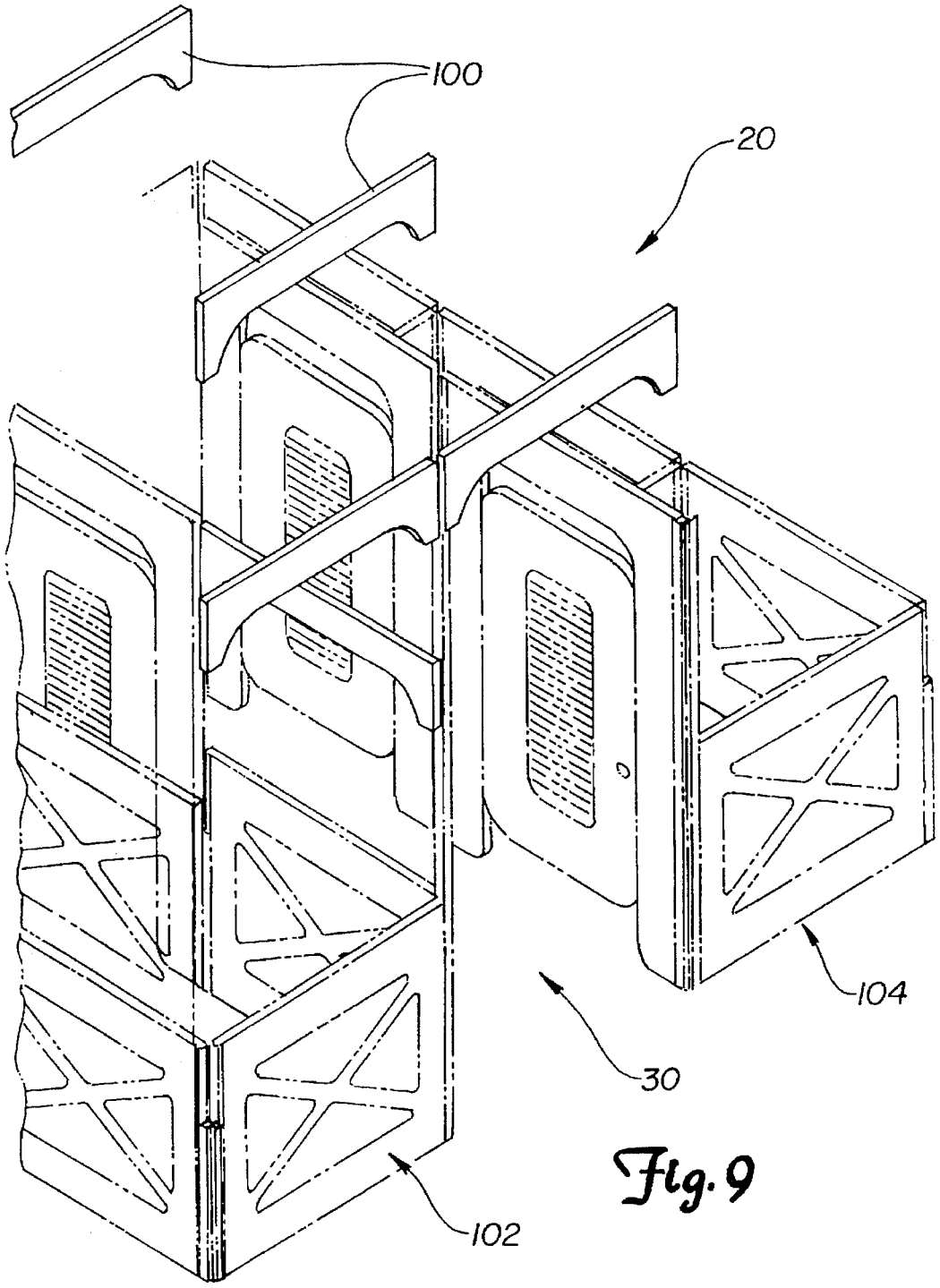
FIG. 9 is a perspective view of archway members connecting two groups of modular changing rooms.

FIG. 9 is a schematic illustration of the exemplary modular changing room system 20 of FIG. 1 including archway members 100 for attaching adjacent rows of changing rooms 102, 104 on opposite sides of the hallway 30. The archway members 100 provide additional support to the modular changing room system 20, especially when merchandise display racks 67 are attached to any of the outer surfaces of the modular changing room system assembly.

Figure 10:
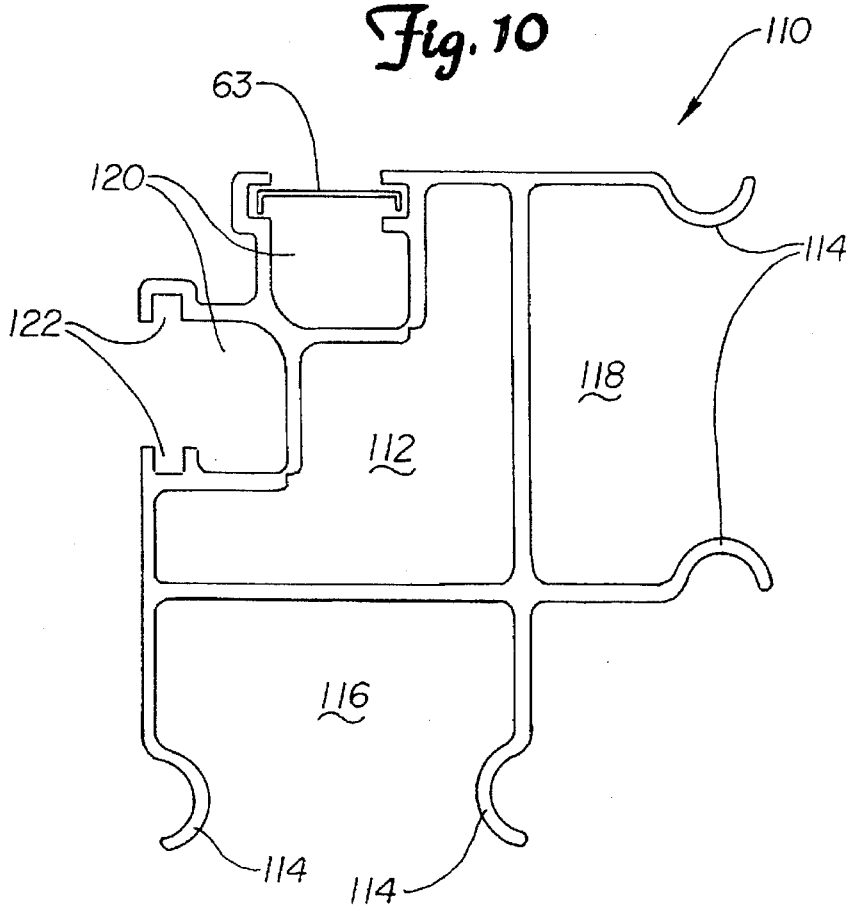
FIG. 10 is a sectional view of a 2×90 panel support column.

FIG. 10 is a sectional view of an alternate 2×90 panel support column 110 having a structural opening 112. Flanges 114 are formed inward of channels 116 and 118 for engagement with the slots 44, 46 on the wall panels 22, 60 and door panel assemblies 24. An elongated recess 120 is provided on outer surfaces of the panel support column 110 for receiving merchandise display support members 63.

Figure 11:
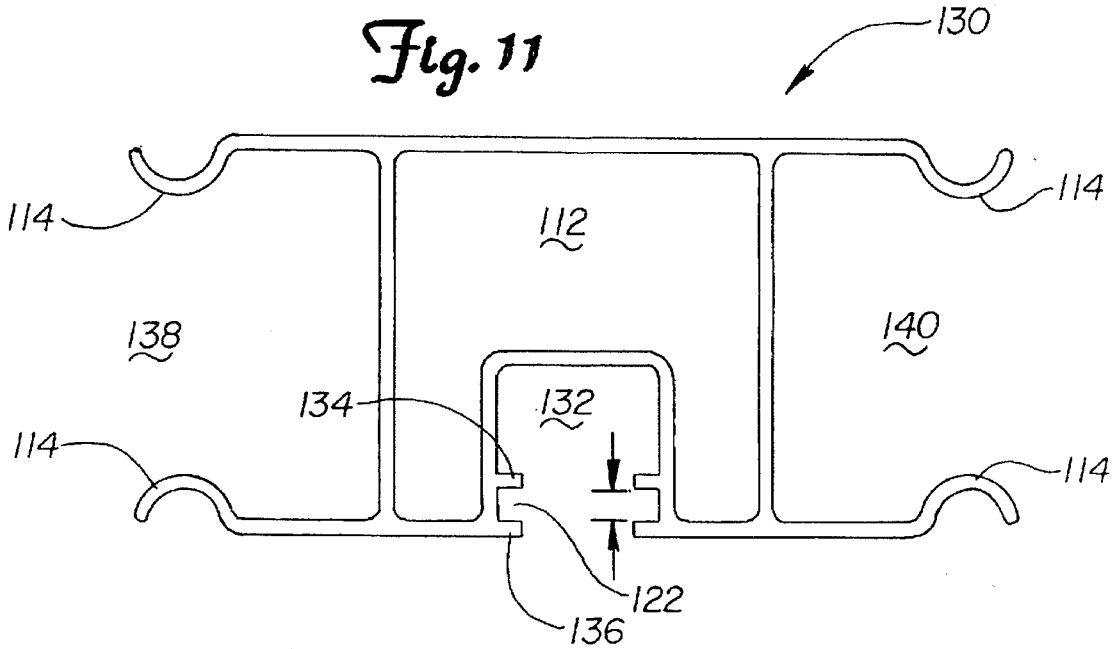
FIG. 11 is a sectional view of a 2×180 panel support column.

FIG. 11 is an alternate 2×180 panel support column 130 having a similar recess 132 defining an elongated slot 122. The panel support column 130 includes a pair of channels 138, 140 spaced 180° apart. Flanges 114 extend into the channels 138, 140 for engagement with the wall panels 22, 60 and door panel assemblies 24. In the embodiment illustrated in FIG. 11, inner and outer tabs 134, 136 are provided for defining the elongated slot 122.

Figure 12:
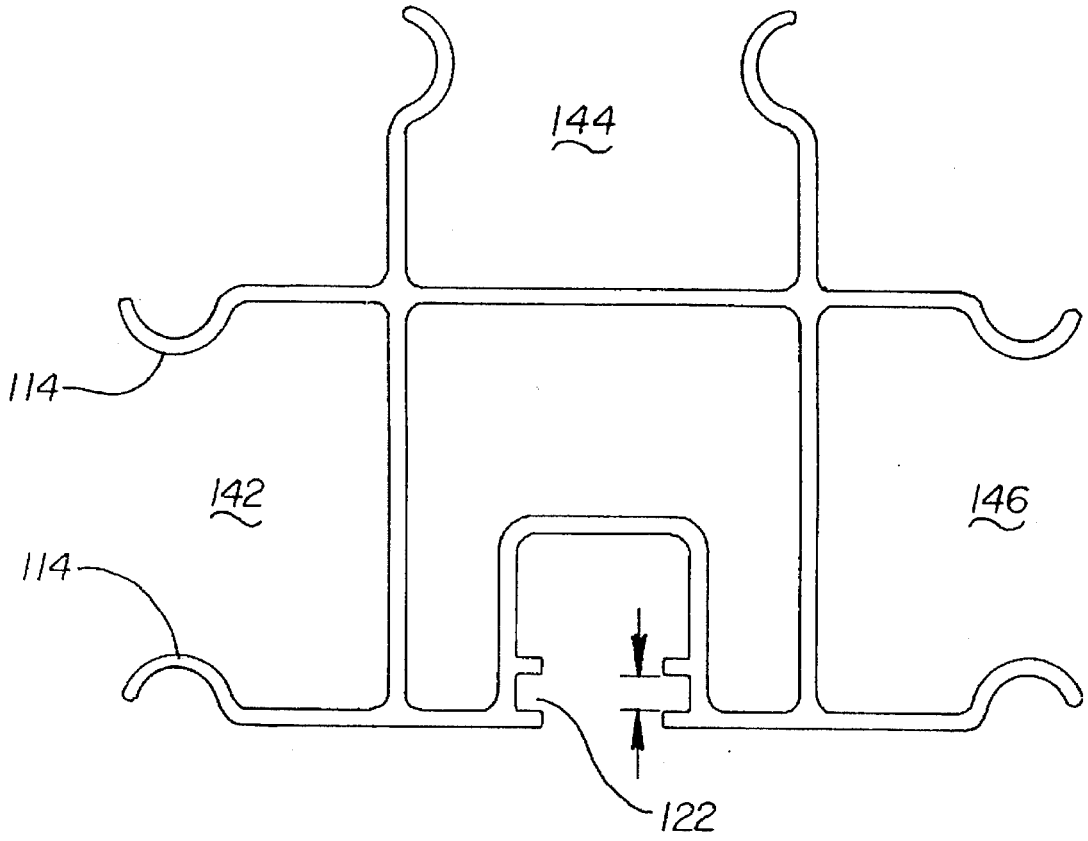
FIG. 12 is a sectional view of a 3×90 panel support column.

FIG. 12 illustrates an alternate 3×90 panel support column defining the channels 142, 144, 146 at 90° intervals. Flanges 114 extend into the channels 142, 144, 146 for engagement with the wall panels 22, 60 and door panel assemblies 24. The elongated slot 122 is provided on the fourth side of the panel support column 141 for receiving a merchandise display support member 63.

In the embodiment discussed above, the lower and upper wall panels 24 and 60 are identical, and therefore fully interchangeable. Consequently, the modular changing room system 20 of FIGS. 1 and 2 may be constructed from five unique components—wall panels, door panel assemblies, and three variations of the panel support columns. If the handicap access room 34 is removed, the 2×180 panel support column 130 is no longer needed, and the entire modular changing room system 20 can be constructed from four unique components.

Although the invention has been described with respect to specific preferred embodiments, it should be appreciated that other embodiments utilizing the concept of the present invention are possible without departing from the scope of the invention. The invention, for example, is not intended to be limited to the specific cross section of the panel support columns disclosed in the embodiments; rather the invention is defined by the claims and equivalents thereof.

What is claimed is:

1. A modular changing room system, comprising:

a plurality of extruded panel support columns each having at least two pairs of opposing side walls, each side wall having at least one flange protruding into a channel defined by each pair of opposing side walls;

a plurality of plastic wall panels comprising;

a plurality of upper wall panels each having top and bottom portions and a pair of side portions, the side portions having a pair of elongated slots slidably engaged with one of the flanges in one of the channels;

a plurality of lower wall panels each having top and bottom portions and a pair of side portions, the side portions having a pair of elongated slots slidably engaged with one of the flanges in one of the channels, the top and bottom portions of the upper and lower wall panels, respectively, having mating portions forming an interlocking seal such that the upper and lower wall panels are interchangeable, the upper and lower wall panels forming an interconnect along the mating portions to form portions of the modular changing room; and at least one plastic door panel assembly having door panel side edge portions, a top edge joining the side edge portions and a doorway, the door panel side edge portions having a pair of elongated slots slidably engaged with flanges in one of the channels, the doorway having a door hinged to the door panel assembly, whereby the plurality of wall panels and the at least one door panel assembly define a plurality of changing rooms, the extruded panel support columns having a length less then a length of the side portions of the lower wall panels such that one of the extruded panel supports extends past the interconnect between the upper and lower wall panels.

2. The apparatus of claim 1 wherein the flanges and elongated slots comprise complementary curved surfaces.

3. The apparatus of claim 1 wherein at least one of the plurality of extruded panel support columns includes a recess for receiving a merchandise display support member along a surface of the at least one changing room.

4. The apparatus of claim 1 wherein the plurality of changing rooms define a hallway.

5. The apparatus of claim 4 further including archway connectors for connecting the plurality of changing rooms.

6. The apparatus of claim 1 wherein the at least one door panel assembly is symmetrical.

7. The apparatus of claim 1 wherein the at least one door panel assembly and the plurality of wall panels have a common width dimension.

8. A kit for constructing a modular changing room system, comprising:

a plurality of extruded panel support columns each having at least two pairs of opposing side walls, each side wall having at least one flange protruding into a channel defined by each pair of opposing side walls;

a plurality of plastic wall panels comprising;

a plurality of upper wall panels each having top and bottom portions and a pair of side portions, the side portions having a pair of elongated slots slidably engaged with one of the flanges in one of the channels;

a plurality of lower wall panels each having top and bottom portions and a pair of side portions, the side portions having a pair of elongated slots slidably engageable with the flanges in the channels, the top and bottom portions of the upper and lower wall panels, respectively, having mating portions to form an interlocking seal such that the upper and lower wall panels are interchangeable, the upper and lower wall panels forming an interconnect along the mating portions to form portions of the modular changing room; and at least one plastic door panel assembly having door panel side edge portions, a top edge joining the side edge portions and a doorway, the door panel side edge portions having a pair of elongated slots slidably engageable with the flanges in the channels, the doorway having a door hinged to the door panel assembly, whereby the plurality of wall panels and at least one door panel assembly may be connected using the plurality of extruded panel support columns to define a plurality of changing rooms, the extruded panel support columns having a length less then a length of the side portions of the lower wall panels such that one of the extruded panel support extends past the interconnect between the upper and lower wall panels.

9. The apparatus of claims 1 or 8 wherein the extruded panel support columns have a length approximately equal to one-third the height of the door panel assembly.

10. The apparatus of claims 1 or 8 wherein the lower wall panels are approximately half the height of the door panel assembly.

11. A method for assembling a modular changing room system, comprising the steps of:

providing a plurality of extruded panel support columns each having at least two pairs of opposing side walls, each side wall having at least one flange protruding into a channel defined by each pair of opposing side walls;

slidably engaging the plurality of extruded panel support columns with side edge portions of upper and lower plastic wall panels, the side edge portions having a pair of elongated slots configured to engage with one of the flanges in one of the channels, the upper and lower wall panels further having top and bottom edge portions with mating portions forming an interlocking seal, respectively, such that upper and lower plastic wall panels are interchangeable, the extruded panel support columns having a length less then a length of side portions of the lower wall panels such that one of the extruded panel support extends past an interconnect formed along a mating portion between the upper and lower wall panels; and slidably engaging door panel side edge portions of at least one plastic door panel assembly with the flanges on the extruded panel support columns, the door panel assembly having a top edge joining the side edge portions, the door panel side edge portions having a pair of elongated slots configured to slidably engaged with the flanges, the at least one door panel assembly having a doorway with a door hinged thereto, whereby the wall panels and at least one door panel assembly define a plurality of changing rooms.

12. The method of claim 11 further including the step of:

slidably engaging a merchandise display support member into a recess in the panel support columns, the recess being located on a surface to the at least one changing room; and attaching a merchandise display to the display support member.

13. The method of claim 10 wherein the at least one door panel assembly is symmetrical.

14. The method of claim 11 wherein the at least one changing room comprises a plurality of changing rooms.

15. The method of claim 14 further including the step of connecting the plurality of changing rooms with at least one archway connector.

* * * * *